US005845493A

United States Patent [19]

Schiffer

[11] Patent Number: 5,845,493

[45] Date of Patent: Dec. 8, 1998

[54] METHOD AND APPARATUS FOR OPERATING A HYDRAULIC DRIVE

[75] Inventor: Alfred Schiffer, Obersteinebach, Germany

[73] Assignee: Dr. Boy GmbH, Germany

[21] Appl. No.: 858,029

[22] Filed: May 16, 1997

[30] Foreign Application Priority Data

May 31, 1996 [DE] Germany ..... 196 21 905.1

[51] Int. Cl.[6] ..... F16D 31/00

[52] U.S. Cl. ..... 60/327; 60/432

[58] Field of Search ..... 60/327, 431, 432

[56] References Cited

U.S. PATENT DOCUMENTS 3,505,814 4/1970 Beard et al. ..... 60/432 X 5,469,946 11/1995 Nguyen ..... 60/432 X 5,680,761 10/1997 Hada et al. ..... 60/432

*Primary Examiner*—Hoang Nguyen

*Attorney, Agent, or Firm*—Blakely Sokoloff Taylor & Zafman

[57] ABSTRACT

The drive includes a reversible variable output pump (1), which supplies a hydraulic working machine (6) and is driven by an asynchronous motor (2). The working machine is intermittently hydraulically pressurized. During these times the asynchronous motor can be switched off since the subsequent start-up process, which causes a high current consumption in the case of asynchronous motors, is effected by the variable output pump. Before the beginning of the start-up process the variable output pump is preset to the maximum negative discharge rate by its proportional valve (10) being acted on by a control pressure. The volume pressurized in the working machine is then applied to the output side of the variable output pump. The asynchronous motor is connected to the current supply network after reaching a minimum speed.

16 Claims, 1 Drawing Sheet

METHOD AND APPARATUS FOR OPERATING A HYDRAULIC DRIVE

FIELD OF THE INVENTION

The invention relates to a method and an apparatus for operating a hydraulic drive for at least one hydraulic working machine, at least one reversible variable output pump, which is connectable to the hydraulic working machine, being driven by an electric asynchronous motor.

DESCRIPTION OF THE PRIOR ART

Such drives consume relatively large amounts of energy, in use, since the asynchronous motor runs continuously, even if no output is being taken from the variable output pump.

It is therefore the object of the invention to provide the possibility for energy-saving operation of the hydraulic drive.

SUMMARY OF THE INVENTION

In order to solve this object the method referred to above is characterised by the following steps:

a) the asynchronous motor is disconnected from the current supply network, b) the variable output pump is connected to a depressurisable hydraulic volume to restart the drive, c) the asynchronous motor is reconnected to the current supply network after reaching a minimum speed.

It was not previously possible temporarily to stop the asynchronous motor since its current consumption when subsequently started up, is so high that the energy saving during the periods of stoppage is more than compensated for. The invention is based on the recognition that the reversible variable output pump operates as a motor when pressure is applied to it, whereby it is surprising that the drive power is sufficient to accelerate the asynchronous motor to a speed at which the current consumption peak during the start-up process is at least substantially reduced. Even short periods of stoppage can be used for energy saving.

It is proposed in an important embodiment of the invention that the hydraulic working machine is acted upon by a pressurised hydraulic volume and that for the purpose of carrying out step c) the pressurised hydraulic volume is connected to the variable output pump when the hydraulic working machine is vented. It can be advantageous, if necessary, to remove an additional depressurisable hydraulic volume from a pressure reservoir which is subsequently filled up during operation, by the variable output pump.

The main field of application of the invention is injection moulding machine technology. The mould closing unit, amongst other things, is hydraulically actuated. During the injection process the closing unit is hydraulically pressurised, the closing pressure being maintained during the cooling period. No output is generally required from the variable output pump during this cooling period. The asynchronous motor can thus be disconnected from the current supply network during this period. The subsequent starting up process then requires no additional pressure energy since the hydraulic volume pressurised in the closing unit must in any event be depressurised. The system thus supplies from within itself that energy which is required for the power-saving starting of the asynchronous motor.

This advantage is, as mentioned, primarily effective in injection moulding machine technology. It may, however, be used wherever a hydraulic working machine is temporarily held under a closing pressure.

Radial piston pumps, vane pumps, axial piston pumps and the like can be considered for the reversible variable output pumps, that is to say pumps which are variable between positive and negative discharge rates in dependence on predetermined volume flows and pressures.

A preferred possibility for carrying out the method resides in, for carrying out step c), presetting the variable output pump to a positive discharge rate and then applying the depressurisable hydraulic volume to the suction side. Expansion of the depressurisable hydraulic volume can, however, occur even in the inlet pipe of the variable output pump.

It is therefore more advantageous for carrying out step c) to preset the variable output pump to a negative discharge rate and then to apply the depressurisable hydraulic volume to the outlet side. The expansion occurs directly in the variable output pump in this case.

If a number of variable output pumps, which are driven by a common asynchronous motor, are attached for start-up of the latter, this is optimised by appropriately selecting the presetting of the discharge rates. If the asynchronous motor is to be started by a single variable output pump, its positive or negative discharge rate is preferably set to the maximum value. The variable output pump then operates with optimum acceleration.

The apparatus for carrying out the method described above has at least one hydraulic working machine, at least one reversible variable output pump, whose output pipe is connectable to the hydraulic working machine whilst its input pipe conununicates with a tank, and at least one asynchronous motor for driving the variable output pump. In order to solve the object posed, it is characterised in that the variable output pump is connectable to a depressurisable hydraulic volume when the asynchronous motor is temporarily disconnected from the current supply network.

It is particularly advantageous if the depressurisable hydraulic volume is a volume which has been pressurised by the hydraulic working machine and expands when the latter is vented, the variable output pump preferably also being connectable to a pressure reservoir which contains an additional depressurisable hydraulic volume and is subsequently filled up during operation by the variable output pump.

It is also proposed in a further embodiment of the invention that the variable output pump is connectable to the depressurisable hydraulic volume on the inlet side, after presetting to a positive discharge rate, the associated inlet pipe to the tank being temporarily blocked by a shut-off valve. In the rest state, the variable output pump adopts the setting of maximum positive discharge rate, that is to say maximum suction power. The connection to the tank is blocked in this position by the shut-off valve. The variable output pump is then thus driven as a motor by the depressurisable hydraulic volume acting on the inlet side of the variable output pump. The inlet pipe is, however, a pipe with a relatively large area. The shut-off valve must be sized to be correspondingly large. This represents not only a high constructional expense but is also associated with increased leakage losses. There is furthermore the risk of the shut-off valve closing due to a technical defect whilst the variable output pump operates in suction. Draining the hydraulic liquid into the tank is then no longer possible.

Accordingly, it has proved to be advantageous if the variable output pump is connectable to the depressurisable hydraulic volume on the outlet side, after presetting to a negative discharge rate. If only one variable output pump is used, it is preset to maximum negative discharge rate.

If a number of variable output pumps effect the starting process, their positive or negative discharge rates are set to an intermediate value. Furthermore, there is also the possibility with this mode of operation of presetting one of the variable output pumps to maximum discharge rate and the others to a zero discharge rate, the latter optionally after briefly setting to a positive discharge rate in order to admit pressure into the control system. It is assumed in all cases that all the variable output pumps are connected to one and the same asynchronous motor.

It is further proposed in another embodiment of the invention for the mode of operation with a negative discharge rate that an electro-hydraulic proportional valve is provided for controlling the variable output pump, that an electro-hydraulic valve is connected upstream of the proportional valve and that the upstream valve is connectable to a control pressure for presetting the variable output pump to a negative discharge rate. If the electric motor is to be started by means of the variable output pump, the upstream electro-hydraulic valve is controlled so that the necessary pressure differential is produced at the proportional valve by means of the control pressure. The proportional valve sets the variable output pump to a negative discharge rate, whereafter the variable output pump is connected to the depressurisable hydraulic volume. The start-up process begins, particularly at maximum discharge rate, with a high acceleration until the reduced power consumption of the asynchronous motor permits its connection to the current supply.

The proportional valve is a valve which is not connected into the working circuit and whose throttling losses thus do not contribute directly to the efficiency of the drive. All the reversible variable output pumps may be controlled by means of one proportional valve.

The upstream valve is preferably connectable to a pressure reservoir which, if required, supplies the necessary control pressure and is subsequently filled up, during operation, by the variable output pump.

It is proposed as an alternative, which is more advantageous under certain circumstances, that the upstream valve be connected to the depressurisable hydraulic volume and the necessary control pressure be tapped off from it so that no additional measures are thus necessary. The pressure loss of the depressurisable hydraulic volume is negligibly small.

Finally, there is the alternative possibility in a further embodiment of the invention of providing an electromagnet for presetting the variable output pump to a negative discharge rate which makes the upstream valve superfluous in a simple manner.

The invention will be explained in more detail below with reference to preferred exemplary embodiments in conjunction with the accompanying drawings.

DESCRIPTION OF THE PREFERRED EMBODIMENTS

Figure 1:
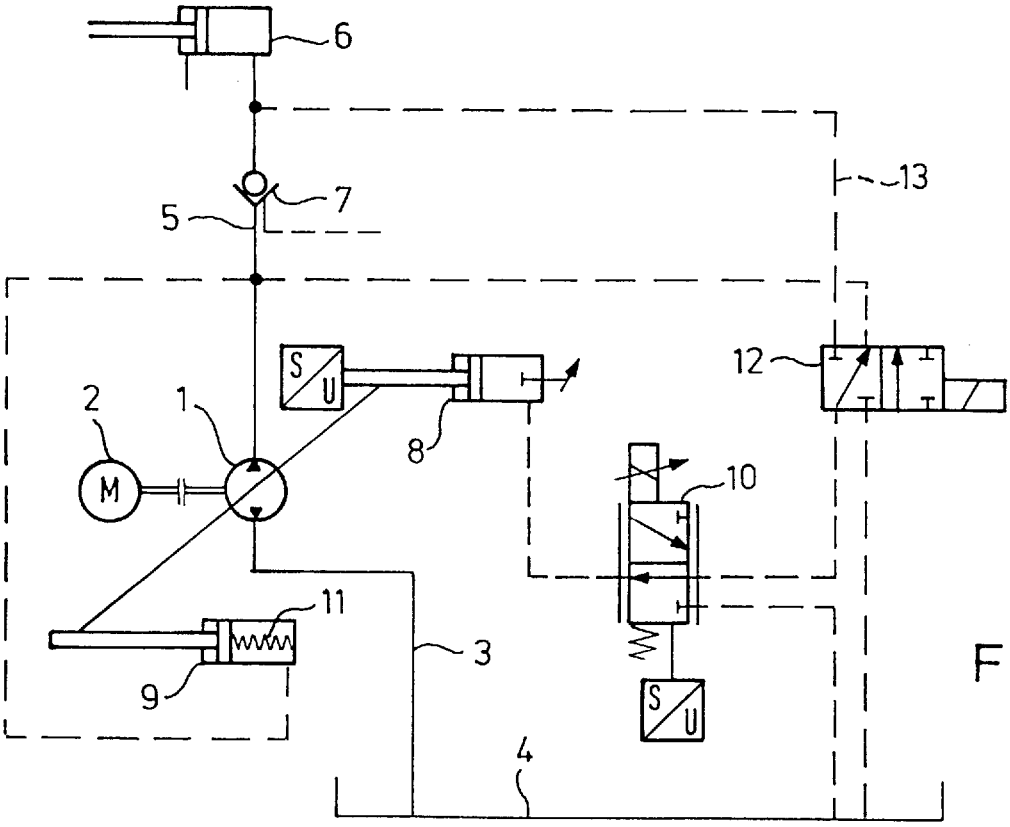
FIG. 1 is a highly schematic and simplified circuit diagram.

FIG. 1 shows a reversible variable output pump 1 which is driven by an asynchronous motor 2. The variable output pump 1 communicates via its input pipe 3 with a tank 4 whilst its output pipe 5 is connected to a hydraulic working machine 6. Disposed in the output pipe 5 is a switchable non-return valve 7 which provides the possibility of subjecting the hydraulic working machine 6 to a holding pressure.

The hydraulic working machine 6 can preferably be the closure unit of an injection moulding machine in which the closure pressure is built up and maintained for a relatively long time with the variable output pump 1 inoperative.

In order to control the variable output pump 1 in dependence on pressure and volume, a control drive 8 is provided which works against an opposing force. The latter is provided by a hydraulic working piston machine 9. The control is effected in dependence on a proportional valve 10.

As soon as the holding pressure has been built up in the hydraulic working machine 6 and no other hydraulic consumer need be supplied by the variable output pump 1, the motor 2 is disconnected from the current supply network. Valves, which are not shown, ensure that the system below the non-return valve 7 is unpressurised. The variable output pump 1 is therefore automatically set to maximum positive discharge rates, namely by a spring 11 which is associated with the working piston machine 9.

As soon as operation is to be resumed, the asynchronous motor 2 is accelerated by the variable output pump 1 to a speed at which the current requirement of the asynchronous motor has reduced substantially to the normal level. Only then is the asynchronous motor connected to the current supply network.

In order to control this procedure, an electro-hydraulic valve 12 is connected upstream of the proportional valve 10. It is connected via a control pipe 13 to the output pipe 5 of the variable output pump 1 at a point above the controllable non-return valve 7.

The drawing shows the upstream valve 12 in its de-energised position in which the control pipe 13 is blocked. If the valve 12 is energised, a control pressure is applied to the proportional valve 10. This actuates the control drive 8 such that the variable output pump 1 is set to the maximum negative discharge rate. The non-return valve 7 is then opened. The pressurised hydraulic volume in the hydraulic working machine 6 is depressurised via the variable output pump 1 which then operates in suction and accelerates the asynchronous motor 2 to the predetermined minimum speed.

The advantage of this arrangement resides in that the pressurised volume in the hydraulic working machine 6, which must in any event be depressurised, gives its energy up to the variable output pump 1 and thus starts the asynchronous motor without the supply of electrical power. The electrical energy saved during the period of stoppage of the variable output pump 1 is thus not lost due to the fact that the asynchronous motor 1 starts up under its own power. Furthermore, the control pressure, which the upstream valve 12 applies to the proportional valve 10, when it is energised, is tapped off from the hydraulic volume which is to be depressurised.

Figure 2:
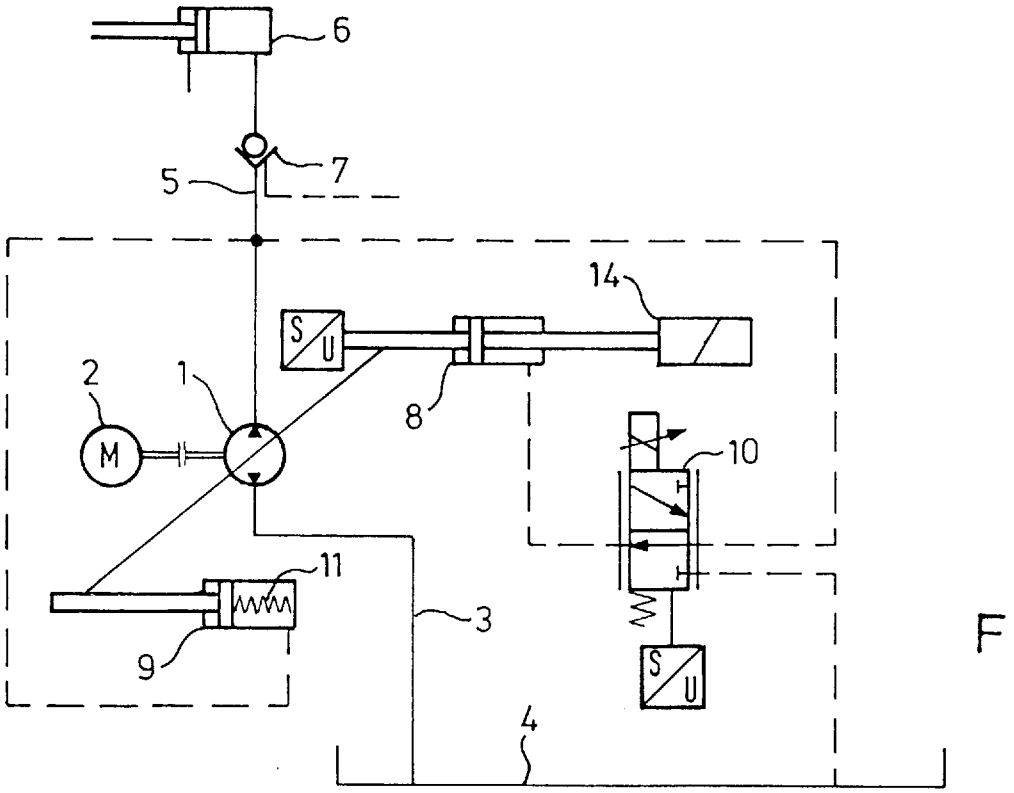
FIG. 2 is a similar view of a modified circuit diagram.

The embodiment of FIG. 2 differs from that of FIG. 1 only in that connected to the control drive 8 there is an electromagnet 14 which presets the variable output pump 1 to the maximum negative discharge rate before the nonreturn valve 7 is opened. The upstream valve 12 in FIG. 1 can thus be omitted.

Modifications are of course possible within the scope of the invention. Thus a pressure reservoir can be provided which makes additional depressurisable hydraulic volume available. The pressure reservoir or a further separate pressure reservoir can also serve to supply the upstream valve 12 with control pressure.

There is further the possibility of applying the depressurisable volume to the input pipe 3 of the variable output pump 1. Since the variable output pump 1 is automatically set in the rest state to the maximum negative discharge rate, the starting procedure can begin without an additional presetting of the variable output pump being absolutely necessary. However, the input pipe 3 of the variable output pump must be temporarily closed off from the tank.

In both the described exemplary embodiments the asynchronous motor 2 is coupled merely to one variable output pump1. There is, however, also the possibility of simultaneously driving a number of variable output pumps via the asynchronous motor. The starting procedure can then proceed in various manners. One possibility is to set one of the variable output pumps to the maximum discharge rate and the other variable output pumps to zero. A number of variable output pumps can also be connected to the depressurisable hydraulic volume, whereby, however, the discharge rate—whether positive or negative—is not set to the maximum value but to an intermediate value. The optimisation is effected so that the depressurisable hydraulic volume available is sufficient reliably to accelerate the asynchronous motor to its minimum speed.

I claim:

1. Method of operating a hydraulic drive which drives at least one hydraulic working machine, the drive including at least one reversible variable output pump, which is connected to the hydraulic working machine, and an asynchronous electric motor, which is connected to a current supply network and drives the variable output pump, the method including the following steps:

a) the asynchronous motor is disconnected from the current supply network in order to stop the drive for a period of time, b) the variable output pump is connected to a depressurisable hydraulic volume after elapse of the period of time in order to restart the drive, and c) when the asynchronous motor has reached a minimum speed, on being restarted, it is reconnected to the current supply network.

2. The method as claimed in claim 1, wherein the hydraulic working machine is acted upon by a pressurised hydraulic volume and wherein the pressurised hydraulic volume is connected to the variable displacement pump when the hydraulic working machine is vented.

3. The method as claimed in claim 2, wherein additional depressurisable hydraulic volume is removed from a pressure reservoir and is connected to the variable output pump.

4. The method as claimed in claim 1, wherein the variable output pump, which has an inlet side and an outlet side, is preset to a positive discharge rate and its inlet side is then connected to the depressurisable hydraulic volume.

5. The method as claimed in claim 4, wherein the variable output pump is preset to the maximum positive discharge rate.

6. The method as claimed in claim 1, wherein the variable output pump, which has an inlet side and an outlet side, is preset to a negative discharge rate and its outlet side is then connected to the depressurisable hydraulic volume.

7. The method as claimed in claim 6, wherein the variable output pump is preset to the maximum negative discharge rate.

8. In a hydraulic drive including at least one hydraulic working machine, at least one reversible variable output pump, which is suitable for being preset to a positive and negative discharge rate and which has an output pipe and an input pipe, whereby the output pipe is connected to the hydraulic working machine whilst the input pipe communicates with a tank, and an asynchronous motor for driving the variable output pump, a method of stopping and restarting the drive, said method including the following steps:

a) the asynchronous motor is disconnected from the current supply network in order to stop the drive for a period of time, b) the variable output pump is connected to a depressurisable hydraulic volume after elapse of the period of time in order to restart the drive, and c) when the asynchronous motor has reached a minimum speed, on being restarted, it is reconnected to the current supply network.

9. The drive as claimed in claim 8, wherein the depressurisable hydraulic volume is a volume which is pressurised by the hydraulic working machine and expands when the latter is vented.

10. The drive as claimed in claim 9, wherein the variable output pump is suitable for connection to a pressure reservoir which contains an additional depressurisable hydraulic volume.

11. The drive as claimed in claim 8, wherein the variable output pump is suitable to be connected, after presetting to a positive discharge rate, with its input line to the depressurisable hydraulic volume whilst the input line to the tank is temporarily blocked by a shut-off valve.

12. The drive as claimed in claim 8, wherein the variable output pump is suitable for connection, after presetting to a negative discharge rate, with its output line to the depressurisable hydraulic volume.

13. The drive as claimed in claim 12 wherein an electro-hydraulic proportional valve is provided which controls the variable output pump, an electro-hydraulic valve is connected upstream of the proportional valve and the upstream valve is suitable for connection to a control pressure in order to set the variable output pump to a negative discharge rate.

14. The drive as claimed in claim 13, wherein the upstream valve is suitable for connection to a pressure reservoir.

15. The drive as claimed in claim 13, wherein the upstream valve is suitable for connection to the depressurisable hydraulic volume.

16. The drive as claimed in claim 12, wherein an electromagnet is provided in order to set the variable output pump to a negative discharge rate.

* * * * *